US008652321B2

(12) United States Patent
Debuisschert et al.

(10) Patent No.: US 8,652,321 B2
(45) Date of Patent: Feb. 18, 2014

(54) PROCESS FOR THE PRODUCTION OF A DESULFURIZED GASOLINE FROM A GASOLINE FRACTION THAT CONTAINS CONVERSION GASOLINE

(75) Inventors: Quentin Debuisschert, Rueil Malmaison (FR); Denis Uzio, Marly le Roi (FR); Jean-Luc Nocca, Houston, TX (US); Florent Picard, Saint Symphorien d'Ozon (FR)

(73) Assignee: IFP Energies nouvelles, Rueil-Malmaison Cedex (FR)

( * ) Notice: Subject to any disclaimer, the term of this patent is extended or adjusted under 35 U.S.C. 154(b) by 781 days.

(21) Appl. No.: 12/791,492

(22) Filed: Jun. 1, 2010

(65) Prior Publication Data

US 2010/0307958 A1 Dec. 9, 2010

Related U.S. Application Data

(63) Continuation of application No. 10/094,985, filed on Mar. 12, 2002, now abandoned.

(60) Provisional application No. 60/294,594, filed on Jun. 1, 2001.

(30) Foreign Application Priority Data

Mar. 12, 2001 (FR) ..... 01 03358
Apr. 23, 2001 (FR) ..... 01 05538

(51) Int. Cl.
*C10G 65/12* (2006.01)

(52) U.S. Cl.
USPC ..... 208/57; 208/58; 208/88; 208/89; 208/95; 208/97; 208/211; 208/212; 585/259; 585/446

(58) Field of Classification Search
USPC ..... 208/57, 58, 88, 89, 95, 97, 211, 212; 585/259, 446
See application file for complete search history.

(56) References Cited

U.S. PATENT DOCUMENTS

| | | | | |
|---|---|---|---|---|
| 3,691,066 | A | 9/1972 | Carruthers et al. | |
| 3,733,260 | A | 5/1973 | Davies et al. | |
| 5,599,441 | A | 2/1997 | Collins et al. | |
| 5,770,047 | A | 6/1998 | Salazar et al. | |
| 6,303,020 | B1 * | 10/2001 | Podrebarac et al. | 208/210 |
| 6,444,118 | B1 | 9/2002 | Podrebarac et al. | |
| 2002/0166798 | A1 | 11/2002 | Debuisschert et al. | |

FOREIGN PATENT DOCUMENTS

| | | |
|---|---|---|
| EP | 0 755 995 | 1/1997 |
| EP | 1 077 247 | 2/2001 |
| EP | 1 138 749 | 10/2001 |
| WO | WO 94/22980 | 10/1994 |

* cited by examiner

*Primary Examiner* — Prem C Singh
*Assistant Examiner* — Michelle Stein
(74) *Attorney, Agent, or Firm* — Millen, White, Zelano & Branigan, P.C.

(57) ABSTRACT

Production of gasolines with low sulfur contents from a starting gasoline containing sulfur-containing compounds comprising a stage a) for selective hydrogenation of non-aromatic polyunsaturated compounds present in the starting gasoline, a stage b) for increasing the molecular weight of the light sulfur-containing products that are initially present in the gasoline that enters this stage, a stage c) for alkylation of at least a portion of the sulfur-containing compounds present in the product that originates from stage b), a stage d) for fractionation of the gasoline that originates from stage c) into at least two fractions, one fraction virtually lacking in sulfur-containing compounds, whereby the other contains a larger proportion of sulfur-containing compounds (heavy gasoline), a stage e) for catalytic treatment of the heavy gasoline for transformation of sulfur-containing compounds under conditions for the at least partial decomposition of hydrogenation of these sulfur-containing compounds.

19 Claims, 1 Drawing Sheet

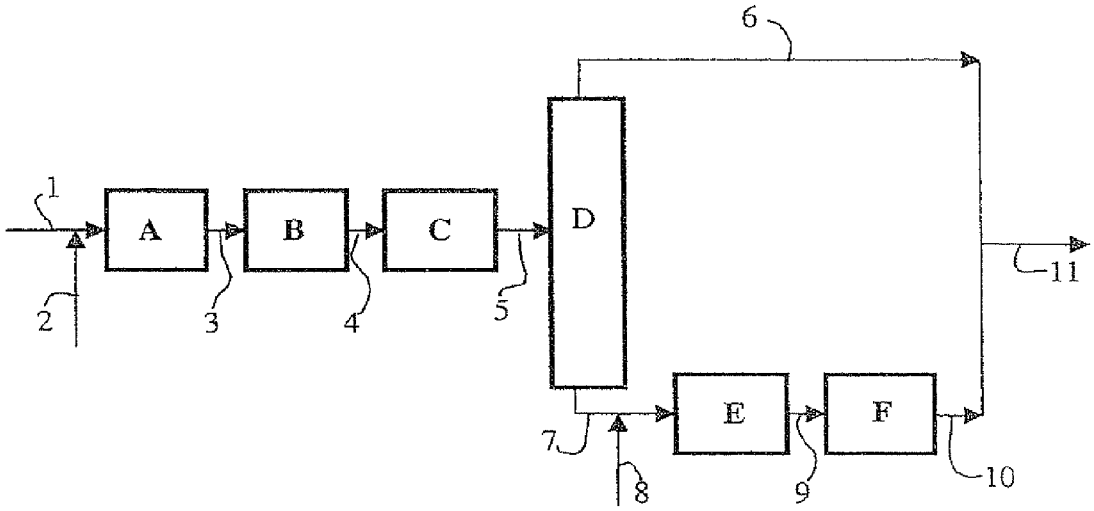
6
1
A
B
C
D
11
2
3
4
5
E
F
7
8
9
10

PROCESS FOR THE PRODUCTION OF A DESULFURIZED GASOLINE FROM A GASOLINE FRACTION THAT CONTAINS CONVERSION GASOLINE

This application is a continuation of U.S. patent application Ser. No.: 10/094,985, filed Mar. 12, 2002, now abandoned which claims the benefit of U.S. Provisional Application Ser. No. 60/294,594 filed on Jun. 1, 2001, both of which are incorporated by reference herein.

TECHNICAL FIELD OF THE INVENTION

The invention relates to a scheme for desulfurization of conversion gasolines and in particular gasolines that are obtained from catalytic cracking, fluidized-bed catalytic cracking (FCC), a coking (in English) process, a visbreaking (in English) process, a pyrolysis process. This process can also treat direct distillation gasolines (straight run, in English) that are mixed with at least one of the gasolines cited above. The process of this invention makes it possible to reach high desulfurization rates while limiting the octane loss due to the saturation of the olefins that are observed during the hydrodesulfurization reactions. The invention relates to a process for the production of gasoline with a low sulfur content comprising a hydrogenation, a stage for transformation of sulfur-containing compounds, a stage for alkylation of sulfur-containing compounds that are not transformed in the preceding stage, a fractionation into a light fraction and into at least one heavy fraction and optionally one or more intermediate fractions, and a hydrodesulfurization of a heavy fraction and/or an intermediate fraction. This process makes it possible to upgrade a gasoline fraction that optionally also comprises hydrocarbons with two, three or four carbon atoms, by reducing the total sulfur content of said fraction to very low levels that are compatible with the current or future specifications. This desulfurization is furthermore carried out without an appreciable reduction of the gasoline yield and by minimizing the reduction of the octane number.

PRIOR ART

The production of reformulated gasolines that meet new environmental standards requires in particular that their olefin concentration be reduced slightly but that their sulfur concentration be reduced to a significant extent. The conversion gasolines and more particularly the one that is obtained from catalytic cracking, which may represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or fluidized-bed catalytic cracking). The desulfurization (hydrodesulfurization) of gasolines and primarily FCC gasolines is therefore of obvious importance for achieving the specifications.

The hydrodesulfurization of the feedstock that is sent to catalytic cracking produces gasolines that typically contain 100 ppm of sulfur. The hydrotreatment units of catalytic cracking feedstocks operate, however, under severe temperature and pressure conditions, which assumes a significant hydrogen consumption and a high investment. In addition, all of the feedstock should be desulfurized, which involves the treatment of very large volumes of feedstock.

The hydrodesulfurization of the cracking gasolines, when it is carried out under standard conditions that are known to one skilled in the art, makes it possible to reduce the sulfur content of the fraction. This process, however, exhibits the major drawback of causing a very significant drop in the octane number of the fraction caused by the saturation of all of the olefins during hydrotreatment.

The teaching of the prior art is extremely non-specific, and a large number of solutions have been considered to obtain a desulfurized gasoline that meets the standards that are currently in force and future standards that can be foreseen for the years 2005-2010 both from the standpoint of the sulfur content and the standpoint of the content of aromatic compounds and the value of the desired octane number. Thus, it is possible to cite, for example, the process that is described in U.S. Pat. No. 4,131,537 that teaches that it is advantageous to fractionate the gasoline into several fractions, preferably three, as a function of their boiling point, and to desulfurize them under conditions that may be different and in the presence of a catalyst that comprises at least one metal of group VIB and/or of group VIII. This patent indicates that the greatest benefit is obtained when the gasoline is fractionated into three fractions and when the fraction that has intermediate boiling points is treated under mild conditions.

It is also possible to cite the teaching of Patent Application EP-A-0 725 126 that describes a process for hydrodesulfurization of a cracking gasoline in which the gasoline is separated into a number of fractions comprising at least a first fraction that is rich in compounds that are easy to desulfurize and a second fraction that is rich in compounds that are difficult to desulfurize. Before carrying out this separation, it is necessary to determine in advance the distribution of the sulfur-containing compounds by means of analyses. These analyses are necessary for selecting the equipment and the separation conditions.

In this application, it is thus indicated that the olefin content and the octane number of a light cracking gasoline fraction drop significantly when the fraction is desulfurized without being fractionated. In contrast, the fractionation of said light fraction into 7 to 20 fractions, followed by analyses of the sulfur and olefin contents of these fractions, makes it possible to determine the fraction or fractions that are the richest in sulfur-containing compounds, which are then desulfurized simultaneously or separately and mixed with other fractions that may or may not be desulfurized. Such a procedure is complex and should be implemented at each change in the composition of the gasoline that is to be treated.

Processes for hydrotreatment of gasolines consisting in fractionating the gasoline, then in introducing the fractions at different levels of a hydrodesulfurization reactor and in converting the desulfurized fractions on a ZSM-5 zeolite to compensate for the octane loss that is recorded by means of an isomerization, have also been proposed in, for example, U.S. Pat. No. 5,290,427. This isomerization is accompanied by a cracking of the gasoline into lighter compounds.

In these processes, the gasolines that are to be treated in general have a starting point that is greater than 70° C., and there again it is necessary to treat the light gasoline (fraction that corresponds to the compounds with boiling points between C5 hydrocarbons with 5 carbon atoms and 70° C.) separately, for example by softening.

According to the teaching of U.S. Pat. No. 5,599,441, the process for desulfurization of a naphtha fraction comprising an olefinic gasoline comprises a stage for increasing the weight of sulfur-containing compounds by alkylation followed by a stage for fractionation of the gasoline into two fractions, whereby the light gasoline becomes depleted of sulfur.

According to the teaching of U.S. Pat. No. 6,024,865, the process for the production of desulfurized gasoline comprises a separation of the gasoline into a light gasoline and a heavy gasoline. The light gasoline is sent to a reactor for increasing the weight of sulfur-containing compounds by alkylation. The heavy gasoline that is supplemented with reactive olefins is sent to a reactor for increasing the weight of sulfur-containing compounds by alkylation. The heavy gasoline and the light gasoline are mixed then sent to a distillation that makes it possible to recover, at the top, a gasoline that is depleted of sulfur.

According to the teaching of the document of Patent EP-A-1 077 247 of the applicant, the gasoline that is to be desulfurized is treated in a process that comprises a stage a1) for selective hydrogenation of diolefinic compounds, optionally at least one stage a2) that aims at increasing the molecular weight of the light sulfur-containing products present in the starting gasoline to be desulfurized, at least one stage b) for separation of the gasoline that is obtained at the outlet of stage a1) and/or a2) into two separate fractions including a light fraction that is virtually lacking in sulfur and that contains the lightest olefins of the starting gasoline and the other heavy fraction that contains almost all of the sulfur-containing compounds that are present in the starting gasoline and/or sulfur-containing compounds that originate from stage a2), at least one stage c) for treatment of the heavy fraction that makes it possible to decompose or to hydrogenate the unsaturated sulfur-containing compounds that are present in this fraction and in particular the cyclic, and even aromatic sulfur-containing compounds under limited hydrogenation conditions of the olefins that are present in this fraction and at least one stage d) of the gasoline that originates from stage c) that makes it possible to decompose the unsaturated sulfur-containing compounds that are not transformed in stage c), and the linear and/or cyclic saturated sulfur-containing compounds that are present in this gasoline that originates from stage c) with a limited hydrogenation of the olefins that are present. The application of this process brings about a limitation of the temperature at the top of the fractionation column to be able to obtain a top fraction that contains virtually no sulfur and in particular does not contain thiophene. This limitation is thus for the most part detrimental as regards the use of the entire process, since the fraction that can be recovered at the top of the fractionation column is limited in temperature and therefore in amount, which further brings about an then to be treated again with a view to reducing its sulfur content.

This invention makes it possible to produce a desulfurized gasoline while limiting the octane loss by desulfurization. The scheme of this invention is distinguished from standard desulfurization schemes that are based on a desulfurization of the total gasoline. In some cases, these schemes provide a separation of the gasoline into at least two fractions: one fraction that contains the light gasoline and a fraction that contains the heavy fraction, i.e., a gasoline with a final boiling point that is higher than the one of the light gasoline.

The heavy gasoline is desulfurized by, for example, treatment with hydrogen or by absorption of sulfur-containing compounds. The schemes that comprise a hydrogen treatment lead to a significant saturation of olefins, and consequently to a high octane loss.

The light gasoline can be desulfurized under mild conditions by hydrodesulfurization, washing by a basic solution or adsorption on solid, or softened by an oxidation process such as, for example, the Merox® process of the Universal Oil Product (UOP) Company which can be extractive.

Some schemes make it possible to desulfurize only the heavy gasoline, the sulfur-containing compounds that are usually present in the light gasoline (mercaptans) whose weight has been increased in advance upstream from a distillation zone or fractionation zone (splitter in English).

As far as the processes for increasing the weight of sulfur-containing compounds by alkylation presented here are concerned, they make it possible to produce a desulfurized light gasoline, whereby the heavy gasoline concentrates the heavy sulfur-containing compounds and the sulfur-containing compounds that are increased in weight by alkylation. These processes therefore do not make it possible to desulfurize the entire conversion gasoline fraction and particularly the one that is obtained from catalytic cracking units. Furthermore, the weight-increasing processes of the sulfur-containing, compounds by alkylation are based on an acid catalysis. The service life of the catalyst can be limited by the presence of diolefins and basic compounds (primarily nitrogen-containing compounds) in the gasoline that is to be treated.

SUMMARY OF THE INVENTION

This invention relates to a process for the production of gasolines with low sulfur contents, which makes it possible to upgrade the entire gasoline fraction that contains sulfur, preferably a gasoline fraction of catalytic cracking or coking (according to English terminology), or pyrolysis, or else visbreaking (according to English terminology), optionally mixed with a direct distillation gasoline, and to reduce the sulfur contents in said gasoline fraction to very low levels, without appreciable reduction of the gasoline yield while minimizing the reduction of the octane number that is caused by the hydrogenation of the olefins. The feedstock of the process according to the invention can also optionally comprise in addition a gasoline fraction, whereby a C4 fraction comprises hydrocarbons with two, three or four carbon atoms.

This invention relates to a process for the production of gasolines with low sulfur contents from a starting gasoline that contains at least 150 parts per million by weight (ppm), often at least 200 ppm and most often at least 300 ppm of sulfur-containing compounds comprising at least the following stages:

- a stage a) for selective hydrogenation of non-aromatic, polyunsaturated compounds that are present in the starting gasoline,
- at least one stage b) that aims at increasing the molecular weight of the light sulfur-containing products, primarily those that are in the form of mercaptans that have 1 to 6 carbon atoms in their molecules and sulfides that often have 2 to 6 carbon atoms in their molecules that are initially present in the gasoline that is introduced in stage a) and/or those that are contained in the product that originates from stage a),
- at least one stage c) for alkylation of at least a portion of the sulfur-containing compounds, primarily those that are in the form of thiophenic compounds that are present in the product that originates from stage b) that aims at obtaining sulfur-containing compounds with a higher molecular weight,
- at least one stage d) for fractionation of the gasoline that originates from stage c) into at least two fractions, a first fraction that is virtually lacking in sulfur and that contains the lightest olefins of the unconverted starting gasoline in stage c), (light gasoline), at least one other fraction, heavier than said first fraction, enriched with sulfur-containing compounds and preferably at least one so-called heavy fraction that contains the majority of the sulfur-containing compounds that are present in the gasoline that originates from stage c) (heavy gasoline), and at least one stage e) for treatment of at least one of the heavier fractions that originates from stage d) on a catalyst that makes it possible to decompose at least partially the sulfur-containing compounds. Preferably during this stage e), the so-called heavy fraction that is separated at stage d) is treated.

In stages b) and c), the term "primarily" means that during the stage in question, at least 50% of the sulfur-containing compounds that are in the form of the compounds of the indicated type are converted.

Often, stage e) is a stage for treatment of at least one of the heaviest fractions that is separated in stage d) on a catalyst that makes it possible to decompose at least partially the sulfur-containing compounds carried out under conditions where the hydrogenation of the olefins on this catalyst is limited.

According to a preferred embodiment of the invention, the treatment of at least one of the heavier fractions that originates from stage d) and preferably the heavy gasoline is carried out in two stages:

at least one stage e) for treatment of at least one of the heavier fractions and preferably the heavy gasoline that is separated in stage d) on a catalyst that makes it possible to decompose at least partially the sulfur-containing compounds, under conditions where the hydrogenation of olefins on this catalyst is limited, and at least one stage f) for treatment of the product that is obtained in stage e), without elimination of the $H_2S$ that is formed during this stage e), on a catalyst and under conditions that make it possible to decompose at least partially the sulfur-containing compounds that are not transformed during stage e) with a limited hydrogenation of olefins, and preferably to decompose the unsaturated sulfur-containing compounds and the linear and/or cyclic saturated, sulfur-containing compounds that are not transformed during stage e) with a limited hydrogenation of olefins.

Within the meaning of this description, the term polyunsaturated compounds covers the diolefinic hydrocarbon-containing compounds, i.e., that contain two double bonds, whereby the hydrocarbon-containing compounds contain more than two double bonds but are not aromatic, and the hydrocarbon-containing compounds contain at least one triple bond and are present in the starting gasoline. Most often, the starting gasoline contains essentially diolefinic compounds as polyunsaturated compounds. Within the meaning of this description, the gasoline with a low sulfur content that is obtained is a gasoline that contains less than 150 ppm by weight, often less than 100 ppm and most often less than 80 ppm by weight of sulfur.

Stage b) for transformation of light sulfur-containing compounds usually essentially relates to the transformation of saturated sulfur-containing compounds that have a boiling point that is less than 120° C. This stage can optionally be carried out simultaneously to stage a) over all or part of the starting gasoline, in the same reactor or in a different reactor. It can also be carried out separately over all or part of the hydrogenated gasoline in stage a). In this stage b), the thiophene and the thiophenic compounds undergo little transformation. This stage a) for hydrogenation of unsaturated compounds and stage b) that aims at increasing the molecular weight of the saturated light sulfur-containing products that are initially present in the gasoline that is introduced in stage a) thus are optionally carried out simultaneously in a single reaction zone that contains one or more beds of a single catalyst.

Stage c) is a stage for alkylation of the sulfur-containing compounds that usually belong to the group that comprises the thiophene, the thiophenic compounds and the mercaptans that are present in the product that originates from stage b). The optionally present mercaptans are either those that are formed in stage a) and/or b) or those that are present in the starting gasoline and are not converted in stage a) and/or b). This stage can be carried out in one or more reactors in series or in parallel. In the case of a device that comprises several reactors in series, the first reactor may act as a guard bed that is intended to hold up the basic compounds that are optionally present in the starting gasoline. These basic compounds can also be at least in part eliminated before the introduction of gasoline into stage a) for hydrogenation of the polyunsaturated compounds. This elimination is preferably carried out by a treatment with an acid aqueous solution. The operating conditions can be adjusted such that a portion of the starting gasoline olefins are converted into long olefins that are branched by addition reactions between olefins. The operating conditions also can be adjusted so that a portion of the aromatic compounds is increased in weight by alkylation by olefins.

Stage d) for fractionation of the gasoline that is obtained at the end of stage c) comprises the fractionation into at least two fractions: a light fraction that is preferably virtually lacking in sulfur and that contains the lightest olefins of the starting gasoline (light gasoline or light fraction), and a heavy fraction in which preferably the majority of the sulfur-containing compounds that are initially present in the starting gasoline and/or formed during stages a), b) and c) are concentrated (gasoline or heavy fraction). It is also possible to separate the gasoline that is obtained in stage c) into more than two fractions, i.e., for example, a light fraction, at least one intermediate fraction and a heavy fraction. In this case, the intermediate fraction or fractions can be sent to a catalytic reforming unit usually after an intensive desulfurization stage.

Stage e) for treatment of the heavy gasoline and/or an intermediate fraction that contains a proportion of sulfur-containing compounds that is very considerably larger than the one contained in the light fraction is a stage for treatment of this fraction on a catalyst that makes it possible to decompose at least partially the sulfur-containing compounds, in particular the cyclic sulfur-containing compounds, and even aromatic compounds such as, for example, the thiophenic compounds, by being placed under conditions where the hydrogenation of the olefins on this catalyst is limited.

Stage f) is a stage for treatment of the product that is obtained in stage e), without eliminating the H2S that is formed during this stage e), on a catalyst and under conditions that make it possible to decompose or to hydrogenate at least partially the sulfur-containing compounds that are not transformed during stage e), and preferably to decompose or to hydrogenate the unsaturated sulfur-containing compounds and the linear and/or cyclic saturated sulfur-containing compounds that are not transformed during stage e) and in particular the thiophenic compounds and the mercaptans, with a limited hydrogenation of olefins.

Stages e) and f) are most often carried out in at least two successive and separate reaction zones. The catalytic treatments that are carried out during stages e) and f) can be carried out either in a single reactor that contains the two catalysts, or in at least two different reactors. When the treatment is carried out with two reactors, the latter two are placed in series, whereby the second reactor preferably treats the effluent as a whole at the outlet of the first reactor, preferably without separating the liquid and the gas between the first and the second reactor. It is also possible to use several reactors in parallel or in series for one and/or the other of stages e) and/or f).

Furthermore, it is not necessary to eliminate the H2S that is formed during stage e) before sending the effluent from this stage e) to the inlet of the hydrogenation reactor or reactors of stage f).

One of the advantages of the process according to the invention therefore resides in the fact that it is not necessary to adjust the H2S content between stage e) and stage f).

Furthermore, a stage g) is preferably carried out after stage f), and this stage consists, in mixing the light gasoline that is separated in stage d) and at least a portion of the heavy gasoline that originates from stage f) to form the overall desulfurized gasoline that is desired.

The entire desulfurized heavy gasoline that originates from stage f) is preferably mixed with the light gasoline that originates from stage d), without separation of the liquid and gas contained in the heavy gasoline after desulfurization; optionally a simple stripping, by at least one cover gas can be carried out to eliminate the H2S of the extensively desulfurized heavy gasoline, i.e., that usually contains less than 50% by weight and often less than 20% by weight of residual sulfur-containing compounds, relative to the content of sulfur-containing compounds of the heavy gasoline that exits stage d).

In some specific cases, the upgrading of the light gasoline and the desulfurized heavy gasoline is carried out separately. It is then unnecessary to carry out stage g).

For the gasolines whose final boiling point is greater than 130° C., two additional stages may be necessary:

- an additional stage for elimination of basic compounds that can be carried out by washing with an acid aqueous solution that is intended, to eliminate the basic compounds may be necessary before stage c)
- a stage for fractionation of the gasoline that originates from stage d) for fractionation or else one of stages e) or f) for hydrodesulfurization that is intended to separate from the gasoline produced a heavy fraction whose starting point would be, for example, 210° C., and a lighter fraction whose end point would be, for example, 210° C.

In the case where this fractionation is carried out on the gasoline that originates from stage d), the light fraction is sent into stage e).

The feedstock of the process according to the invention is a gasoline fraction that contains sulfur, preferably a gasoline fraction that originates from a cracking unit, most often from a catalytic cracking unit, whose range of boiling points typically extends from approximately the boiling points of hydrocarbons with 2 or 3 carbon atoms (C2 or C3) up to about 250° C., preferably from approximately the boiling points of hydrocarbons with 2 or 3 carbon atoms (C2 or C3) up to about 220° C., more preferably from about the boiling points of hydrocarbons with 5 carbon atoms (C5) up to about 220° C. The process of this invention applies more particularly to the catalytic cracking gasolines whose final boiling points are from about 120° C. to about 230° C.

The advantages of this scheme relative to those of the prior art are as follows:

1. Removal of diene compounds and optionally acetylene compounds, contained in the starting gasoline with a view to limiting the deactivation of the alkylation catalyst of subsequent stage c) of the sulfur-containing compounds as well as the formation of gums in the gasolines.
2. Elimination of light mercaptans for producing a softened light gasoline that does not require purification or subsequent desulfurization.
3. Increase of the production of desulfurized light gasoline that is recovered at the top of the fractionation column, which induces a reduction of the amount of gasoline to be treated by hydrodesulfurization.
4. Production, by fractionation of a branched olefin-rich heavy gasoline whose octane is not very sensitive to the saturation of olefins.
5. Selective desulfurization of the heavy gasoline (or result of lateral drawing-off) to limit the saturation of olefins and the octane loss of heavy gasoline.
6. Overall reduction of the vapor pressure of the gasoline that is produced relative to the starting gasoline.

DETAILED DESCRIPTION OF THE INVENTION

This invention describes a process that makes it possible to obtain a desulfurized gasoline from a conversion gasoline and preferably from a gasoline that originates from a unit for catalytic cracking, coking, visbreaking, or pyrolysis optionally mixed with a saturated gasoline and that has a limited sulfur content in which the gasoline first undergoes a selective hydrogenation treatment of diolefins, then a stage for transformation of sulfur-containing compounds of the gasoline that are present in the form of mercaptans that have 1 to 6 carbon atoms in their molecule and sulfides that have often 2 to 6 carbon atoms, which, after fractionation, should be found in the light gasoline such that they are essentially in the heavy fraction after the fractionation stage of the process according to the invention, a stage for alkylation of the sulfur-containing compounds that are present in the form of thiophenic compounds in the gasoline that originates from the stage for transformation of the sulfur-containing compounds in the form of mercaptans and sulfides. In this stage, the operating conditions can be adjusted so as to promote the alkylation reactions of olefins on olefins and aromatic compounds, which causes, in particular, a reduction in the vapor pressure of the gasoline. At least one fraction that originates from the fractionation stage, preferably the heavy fraction or an intermediate fraction, can be treated in a stage for transformation of these sulfur-containing compounds into H2S (hydrogen sulfide) with or without reduction of the saturation of olefins.

After said fractionation, the heavy gasoline or at least one intermediate fraction is treated in a hydrodesulfurization section, preferably in the presence of a hydrodesulfurization catalyst or optionally an absorbent. Preferably no desulfurization of the light fraction is necessary in the process according to the invention, since the bulk of the initially present: sulfur-containing compounds in the gasoline are in the heavy fraction and optionally in the intermediate fraction or fractions of fractionation stage d) that is carried out after the stages for hydrogenation, for transformation of the sulfur-containing compounds (stage b), for transformation of thiophenic compounds and optionally mercaptans, in particular residual mercaptans that are not converted and/or formed in stages a) and b) (stage c) by alkylation of at least a portion of the unconverted sulfur-containing compounds in stage b) (stage c).

This scheme makes it possible to obtain in fine a desulfurized gasoline that has no significant reduction in the olefin content or the octane number even for high desulfurization rates; and this is so without it being necessary to treat the light gasoline by means of a hydrodesulfurization section or softening section, or to have recourse to processes that make it possible to recover the octane number of the gasoline. Thanks to this process, significant desulfurization rates are achieved under reasonable operating conditions that are specified below.

The sulfur-containing radicals that are contained in the feedstocks that are treated by the process of the invention can be mercaptans, sulfides, disulfides and/or heterocyclic compounds, such as, for example, thiophene or alkyl-thiophenes, or heavier compounds, such as, for example, benzothiophene and/or dibenzothiophene.

The fractionation point of the gasoline is preferably limited so as to prevent the presence of sulfur-containing compounds in the light gasoline. In the absence of the reactor for alkylation of sulfur-containing compounds, it would be possible to separate in the light gasoline only the C5 olefins and a small portion of the C6 olefins for fear of entraining too large a thiophene fraction into this fraction. Thus, the process according to the invention is advantageous by carrying out a stage for transformation of the thiophene and more generally thiophenic compounds, for example with an alkylation section upstream from the fractionation section or integrated in said section according to a detailed embodiment in the description below.

To make it possible to recover a larger fraction of the light gasoline while limiting the sulfur content of this fraction without additional treatment, it is preferably proposed to treat the feedstock in stage b) under conditions and on catalysts that make it possible to transform the light sulfur-containing compounds that are present in the form of mercaptans and sulfides that most often have 2 to 6 carbon atoms in their molecule into sulfur-containing compounds with a higher boiling point that is found after the separation, optionally in at least one intermediate fraction or in the heavy gasoline. These intermediate and/or heavy fractions can then be desulfurized. This desulfurization is carried out under definite conditions and by means of a hydrodesulfurization catalyst that optionally makes it possible to limit the saturation of the olefins or, according to a preferred embodiment of the invention, by means of a scheme of catalysts that makes it possible to reach high desulfurization rates while limiting the hydrogenation rate of the olefins and therefore the octane loss.

The sulfur content of the gasoline fractions that are produced by catalytic cracking and in particular fluidized-bed catalytic cracking (FCC) depends on the sulfur content of the feedstock that is treated with FCC, the presence or absence of a pretreatment of the feedstock of the FCC, as well as the end point of the fraction. Generally, the sulfur contents of the entire gasoline fraction, in particular the ones that are obtained from the FCC, are greater than 150 ppm by weight and most often greater than 500 ppm by weight. For gasolines that have end points that are greater than 200° C., the sulfur contents are often greater than 1,000 ppm by weight, and they can even in some cases reach values on the order of 4,000 to 5,000 ppm by weight.

The process according to the invention applies particularly when high desulfurization rates of the gasoline are required, i.e., when the desulfurized gasoline should contain at most 10% of the sulfur of the starting gasoline and optionally at most 5% and even at most 2% of the sulfur of the starting gasoline that corresponds to desulfurization rates that are greater than 90% and even greater than 95% or 98%.

The process according to the invention comprises at least stages a) to e) below:

Stage a) for selective hydrogenation of diolefins: this stage is intended to eliminate the diolefins that can bring about a premature deactivation of the catalysts for increasing the weight of sulfur-containing compounds by alkylation during stage c) below and to form gums in the desulfurized gasolines. This stage is carried out by passage of the effluent, preferably consisting of the entire gasoline fraction, on a catalyst that makes it possible to hydrogenate selectively the diolefins of the gasoline without hydrogenating the olefins.

Stage b) for increasing the weight of mercaptans and light sulfides on the supported metal-based catalyst: this reaction can be implemented in the reactor for selective hydrogenation of diolefins. This stage consists in running all or part of the starting gasoline or the gasoline that is hydrogenated in stage a), preferably all of the starting gasoline or gasoline that is hydrogenated in stage a), over a catalyst that makes it possible to transform at least in part the light sulfur-containing compounds (for example: ethylmercaptan, propyl mercaptan), by reaction with all or part of the olefins, into heavier sulfur-containing compounds. This stage is carried out, for example, simultaneously to stage a) by running, for example, the starting gasoline over a catalyst that can both hydrogenate the diolefins and transform the light sulfur-containing compounds, preferably with olefins, into heavier sulfur-containing compounds, or over a separate catalyst but that makes it possible to carry out this transformation in the same reactor as the one that is used for carrying out stage a).

Stage c) is a stage for increasing the weight of sulfur-containing compounds by alkylation. This stage makes it possible to eliminate the majority of the sulfur-containing compounds that are present in the form of thiophenic compounds by a reaction of addition to the olefins. This stage consists in running all or part of the gasoline that is obtained from stage b) over a catalyst that has an acid function that makes it possible to carry out the addition of sulfur-containing compounds in the form of mercaptans and sulfides to the olefins and the alkylation reaction of the thiophene and thiophenic derivatives by these same olefins.

Stage d) for fractionation of the gasoline that is obtained at the end of stage c): this stage is intended to produce a light desulfurized gasoline at the top of the distillation column. The gasoline that is thus recovered is low in sulfur and most often does not require additional treatment. This light gasoline that is low in sulfur is most often sent directly into the storage zone of the gasoline (gasoline pool according to the terminology used most frequently in the art), preferably without additional post-treatment. The gasoline that is recovered at the bottom of the column concentrates the sulfur-containing compounds that are initially present in the feedstock. This column can comprise lateral drawing-off making it possible to obtain, for example, one or more intermediate fractions.

In stage e), the gasoline at the bottom of the column and/or the one that is contained in an intermediate fraction that originates from stage d) is desulfurized by hydrotreatment.

According to a preferred embodiment of the invention, the gasoline at the bottom of the column and/or the one that is contained in an intermediate fraction that originates from stage d) is desulfurized in stage e) on a catalyst and under conditions such that the olefin saturation is partial to limit the octane loss.

According to a more preferred embodiment of the invention, in successive stages e) and f), the gasoline at the bottom of the column and/or the one that is contained in an intermediate fraction that originates from stage d) is desulfurized by hydrotreatment according to a process that makes it possible to limit the saturation of the olefins. Actually, the implementation of a selective hydrodesulfurization makes it possible to limit the saturation of olefins and thus to limit the loss of octane of the gasoline. The heavy gasoline and/or at least one intermediate gasoline that is thus desulfurized can then optionally be stripped (i.e., a gas stream that preferably contains one or more cover gases is run through this gasoline) so as to eliminate the $H_2S$ that is optionally produced during the desulfurization.

According to a variant of the process according to the invention, it is possible to associate at least one reaction section with the fractionation column. Said reaction section or sections then operate on at least one fraction that is sampled inside the fractionation column, and the effluent of the reaction section is sent to the fractionation column. The reaction section or sections thus coupled to the fractionation column of stage d) can be selected from the group that consists of the reaction sections of the following stages:

transformation of sulfur-containing compounds by alkylation, such as, for example, thiophene, thiophenic compounds and optionally mercaptans (stage c)

desulfurization of intermediate fractions and/or desulfurization of the heavy fraction ((stage e) and/or stage f)).

Such devices that comprise a fractionation column combined with an external reactor that can be used in the process according to the invention were described, for example, for applications in the field of refining and petrochemistry in U.S. Pat. Nos. 5,1777,283,5,817,227 and 5,888,355.

According to other variants of the process according to the invention, it is also possible to use a reactive column instead of the fractionation column, i.e., to place at least one of said reaction sections in the fractionation column (reaction section that is inside of the column), preferably in a zone where the reagent concentration is at a maximum. Thus, for example, in the case of stage c) for transformation of sulfur-containing compounds by alkylation, such as, for example, the thiophenic compounds, the reaction section will preferably be placed in a zone that exhibits the maximum concentration of these compounds. According to a preferred variant of the process according to the invention, the reaction section that is inside of the column is selected from the group that consists of the following reaction sections: transformation of sulfur-containing compounds such as thiophene, thiophenic compounds and optionally mercaptans by alkylation (stage c)), desulfurization of the intermediate fractions and/or desulfurization of the heavy fraction ((stage e) and/or stage f).

In a very preferred embodiment of the process according to the invention, the reaction section is placed in the middle of a fractionation column so as to treat the compounds that have intermediate boiling points, e.g., the compounds that can constitute an intermediate fraction and that are recovered alone or with the heavy fraction at the bottom of the column, at the end of the fractionation stage. The heavy fraction is then treated in an external reactor that may or may not be combined with the fractionation column.

Such reactive columns are known to one skilled in the art and have been described in, for example, patents or patent applications U.S. Pat. Nos. 5,368,691, 5,523,062, FR 2,737 131, FR 2,737,132, and EP-A-0 461 855.

Another variant of the process according to the invention consists both in using a reactive column that comprises at least one reaction section and an external reactor that may or may not be coupled to said column. Such variants are described in, for example, Patent Application WO 00/15319.

The variants that are described above are only illustrations of possible variants of the process according to the invention. The process according to the invention actually can be implemented by combining reaction sections (stages a), b), c), e) or f)) either associated with the fractionation column of stage d), or inside of said column, or outside and not coupled to said column in that the effluent of said reaction section or sections is not recycled to the fractionation column.

One of the advantages of the process according, to the invention resides in the fact that most often it is not necessary to desulfurize the light, fraction of the gasoline that originates from fractionation. The transformation of sulfur-containing compounds and/or thiophenic compounds (stages b) and/or c)) actually makes it possible to significantly reduce the content of sulfur-containing compounds of the light fraction and optionally at least one intermediate fraction, and generally to recover the bulk of these compounds in the heavy fraction and optionally in the intermediate fraction or fractions.

Stages b) and c) are distinguished from one another by the fact that the conversion of the thiophenic compounds is generally less than 60% by weight, and even less than 40% by weight in stage b), while the conversion is most often greater than 80% by weight, preferably greater than 90% by weight, very preferably greater than 95% by weight in stage c). Stage b) actually essentially makes the mercaptans and light sulfides heavier whereas stage c) essentially makes the thiophenic compounds heavier.

This operation is carried out while maintaining the bulk of the olefins in the light fraction, optionally in at least one intermediate fraction that does not require intensive desulfurization. The content of sulfur-containing compounds of the light fraction that is thus obtained is generally less than 100 ppm, preferably less than 50 ppm, more preferably less than 20 ppm and very preferably less than 10 ppm.

Another advantage resides in the fact that the residual content of sulfur-containing compounds of the desulfurized gasoline by means of the process according to the invention is particularly low and that the octane number of the gasoline is kept at a high level.

The stages of the process according to the invention are described in more detail below.

Hydrogenation of Diolefins (Stage a):

The hydrogenation of dienes is a stage that makes it possible to eliminate, before hydrodesulfurization, almost all of the dienes that are present in the gasoline fraction that contains the sulfur to be treated. It preferably takes place in the first stage (stage a) of the process according to the invention, generally in the presence of a catalyst that comprises at least one metal of group VIII, preferably selected from the group that consists of platinum, palladium and nickel, and a substrate. For example, a nickel-based or palladium-based catalyst that is deposited on an inert substrate, such as, for example, alumina, silica or a substrate that contains at least 50% of alumina, will be used.

The pressure that is used is adequate for maintaining more than 60%, preferably 80%, and more preferably 95% by weight of the gasoline that is to be treated in liquid phase in the reactor; it is most generally between about 0.4 and about 5 MPa and preferably greater than 1 MPa, more preferably between 1 and 4 MPa. The hourly volumetric flow rate of the liquid that is to be treated is between about 1 and about 20 $h^{-1}$ (volume of feedstock per volume of catalyst and per hour), preferably between 2 and 10 $h^{-1}$ , very preferably between 3 and 8 $h^{-1}$. The temperature is most generally between about 50 and about 250° C., and preferably between 80 and 220° C., and more preferably between 100 and 200° C., to ensure an adequate conversion of diolefins. Very preferably, it is limited to 180° C. The hydrogen to feedstock ratio that is expressed in liters is generally between 1 and 50 liters per liter, preferably between 2 and 30 liters, more preferably between 3 and 25 liters per liter.

The selection of operating conditions is particularly important. The operation most generally will be performed under pressure and in the presence of an amount of hydrogen that slightly exceeds the stoichiometric value that is necessary for hydrogenating the diolefins. The hydrogen and the feedstock that is to be treated are injected in upward or downward flows in a reactor that preferably comprises a fixed catalyst bed.

Another metal can be combined with the main metal to form a bimetallic catalyst, such as, for example, molybdenum or tungsten. The use of such catalytic formulas has been claimed in, for example, Patent FR 2 764 299.

The catalytic cracking gasoline can contain up to several percent (%) by weight of diolefins. After hydrogenation, the diolefin content is generally reduced to less than 3000 ppm, and even less than 2500 ppm, and more preferably less than 1500 ppm. In some cases, less than 500 ppm can be obtained. The diene content after selective hydrogenation can even, if necessary, be reduced to less than 250 ppm.

According to a particular embodiment of the process according to the invention, the hydrogenation stage of the dienes takes place in a catalytic hydrogenation reactor that comprises a catalytic reaction zone that is traversed by all of the feedstock and the amount of hydrogen that is necessary to carry out the desired reactions.

Transformation of Light Sulfur Compounds (Stage b):

This stage consists in transforming the light sulfur compounds, the compounds that would be found at the end of stage a) for hydrogenation of dienes (after fractionation in stage d)) in light gasoline, into heavier sulfur-containing compounds that are entrained in the heavy gasoline. The light sulfur-containing compounds preferably are selected from the families of mercaptans with 1 to 6 carbon atoms and sulfides with 2 to 6 carbon atoms. This transformation is preferably carried out on a catalyst that comprises at least one element of group VIII of the periodic table (Handbook of Chemistry and Physics 45th Edition 1964-1965) (groups 8, 9 and 10 of the new periodic table). The selection of the catalyst is carried out in particular to promote the reaction between the light mercaptans and the olefins, which produces heavier sulfides or mercaptans. Other compounds such as COS or CS2 can optionally also be converted.

This stage optionally can be carried out at the same time as stage a). For example, it can be particularly advantageous to operate, during the hydrogenation of the diolefins, under conditions such that at least a portion of the compounds in mercaptan form are transformed. A certain reduction of the mercaptan content thus is obtained. To do this, it is possible to use the procedure for hydrogenating dienes that is described in Patent Application EP-A-0 832 958, which advantageously uses a palladium-based catalyst, or the one that is described in Patent FR 2 720 754.

Another possibility is to use a nickel-based catalyst that is identical to or different from the catalyst of stage a), such as, for example, the catalyst that is recommended in the process of U.S. Pat. No. 3,691,066, which makes it possible to transform the mercaptans (butylmercaptan) into heavier sulfur-containing compounds (sulfides).

Another possibility for carrying out this stage consists in hydrogenating at least partly the thiophene into thiophane whose boiling point is greater than that of thiophene (boiling point 121° C.). This stage can be carried out on a catalyst with a nickel, platinum or palladium base. In this case, the temperatures are generally between 100 and 300° C., and preferably between 150 and 250° C. The H2/feedstock ratio is adjusted between 1 and 20 liters per liter, preferably between 3 and 15 liters per liter, to promote, if possible, in addition the desired hydrogenation of the thiophenic compounds and to reduce the hydrogenation of the olefins that are present in the feedstock. The volumetric flow rate is generally between 1 and 10 $h^{-1}$, preferably between 2 and 4 $h^{-1}$, and the pressure is between 0.5 and 5 MPa, preferably between 1 and 3 MPa.

Transformation of Sulfur-Containing Compounds by Alkylation (Stage c):

This stage consists in preferably running the entire fraction that originates from stage b) over a catalyst that has an acid function that makes it possible to carry out the addition of sulfur-containing compounds in the form of mercaptans over olefins and the alkylation reaction of thiophene and thiophenic derivatives by these same olefins. The operating conditions are adjusted to carry out the desired transformation with conversion rates of thiophene and/or thiophenic compounds that are greater than 80% by weight, preferably greater than 90% by weight, very preferably greater than 95% by weight. Other compounds such as COS or CS2 can optionally also be converted.

During this stage, a portion of the olefins of the starting gasoline can be converted into branched long olefins by addition reactions (oligomerization) between olefins, and a portion of the aromatic compounds increased in weight by alkylation by the olefins.

To reduce the oligomerizing activity of the acid catalyst that is optionally used, the gasoline can be supplemented with a known compound for inhibiting the oligomerizing activity of the acid catalysts, such as the alcohols, ethers or water.

During the alkylation, the thiophenic compounds whose boiling point is from about 60° C. to about 160° C. will react with conversion rates that are greater than 80% by weight, preferably greater than 90% by weight, with olefins to form thiophene alkyls whose boiling point is considerably larger than the one of the starting thiophenic compounds.

A portion or all of the benzene can also be eliminated by alkylation with the olefins.

These compounds of higher molecular weight are primarily characterized by higher boiling points than those that they had before alkylation. Thus, the theoretical boiling point of the thiophene, which is shifted toward 150° C. for the thiophene alkyls. This reaction is coupled to olefin addition reactions that most bften therefore result in increasing the weight of the gasoline, in particular in the case where the gasoline fraction and/or the starting gasoline are light, and to a reduction of its vapor pressure.

This alkylation stage is carried out in the presence of acid catalyst. This catalyst can be equally a resin, a zeolite, a clay, any silica that is functionalized or any silico-aluminate that has an acidity, or any grafted substrate of acid functional groups. The ratio of the injected feedstock volume to the catalyst volume is between 0.1 and 10 liters/liter/hour and preferably between 0.5 and 4 liters/liter/hour. More specifically, this alkylation stage is carried out in the presence of at least one acid catalyst that is selected from the group that consists of Bronsted acids (including phosphoric acids, sulfuric acids, boric acids, hydrofluoric acids), supported on, for example, silica, alumina or alumina silica, silicoaluminates, titanosilicates, mixed alumina-titanium compounds, clays, resins, mixed oxides obtained by grafting at least one organometallic compound that is organosoluble or water-soluble (selected from the group that consists of alkyls and/or alkoxy metals of at least one element such as titanium, zirconium, silicon, germanium, tin, tantalum, niobium . . . ) on at least one oxide such as alumina (gamma, delta, eta forms, alone or mixed), silica, alumina silicas, titanium silicas, zirconium silicas or any other solid that has any acidity. A particular embodiment of the invention can consist in using a physical mixture of at least two of the catalysts above in proportions that vary from 95/5 to 5/95, preferably from 85/15 to 15/85 and very preferably from 70/30 to 30/70.

The temperature for this stage is generally from about 10 to about 350° C. according to the type of catalyst or the force of the acidity. Thus, for a supported phosphoric acid-type catalyst, the temperature is usually from about 50 to about 250° C., preferably from about 100 to about 210° C.

The molar ratio of olefins to thiophenic compounds is greater than 10 mol/mol, preferably greater than 100 mol/mol.

The operating pressure of this stage is generally between 0.1 and 3 MPa and preferably such that the feedstock is in liquid form under the temperature and pressure conditions, or at a pressure that is higher than 0.5 MPa.

At least part and preferably all of the effluent that originates from stage c) for transformation of sulfur-containing compounds is sent into a fractionation unit (stage d)) to be separated into at least two fractions: a light fraction and a heavy fraction that is preferably sent as a whole optionally after mixing with an intermediate fraction into a desulfurization zone that operates in one (stage e) or two stages for successive desulfurization (stage e) and stage f)).

Separation of the Gasoline that Originates from Stage c) into at Least Two Fractions (Stage d):

According to a first variant of the process according to the invention, the gasoline is fractionated into two fractions:

- a light fraction that contains a limited residual sulfur content, preferably less than about 100 ppm, very preferably less than about 20 ppm, and that makes it possible most often to use this fraction without carrying out other treatment that aims at reducing its sulfur content,
- a heavy fraction in which the bulk of the sulfur that is initially present in the feedstock is preferably concentrated.

This separation is preferably carried out by means of a standard distillation column that is also called a splitter according to the English name. This fractionation column should make it possible to separate a light fraction of the gasoline that contains a small fraction of sulfur and a heavy fraction that preferably contains the bulk of the sulfur that was initially present in the starting gasoline.

This column generally operates at a pressure of between 0.1 and 2 MPa and preferably between 0.2 and 1 MPa. The number of theoretical plateaus of this separation column is generally between 10 and 100 and preferably between 20 and 60. The reflux rate, which is expressed as being the ratio of the liquid flow rate in the column that is divided by the distillate flow rate, expressed in kg/h, is generally less than the unit and preferably less than 0.8.

The light gasoline that is obtained at the end of the separation generally consists of hydrocarbon-containing fractions with 5, 6 and 7 carbons. Generally, this light fraction has a low sulfur content, i.e., it generally is not necessary to treat the light fraction before using it as a fuel.

In this case, the gasoline is preferably fractionated into at least two fractions that have the following properties:

- a so-called light fraction (fraction L) whose boiling points are preferably less than about 120° C. This temperature is given by way of example; it generally corresponds to the maximum temperature for which the sulfur content is less than 20 ppm,
- at least one so-called heavy fraction (fraction H1), whose boiling points are greater than about 100° C.

Light fraction L is preferably injected into a flask for gas-liquid separation so as to separate the unconsumed hydrogen and the H2S, formed during stage a) and/or b) and/or c), whereby olefins generally have 5 to 7 carbon atoms.

So-called heavy fraction H1, i.e., the fraction whose temperatures are greater than about 100° C., is sent into the desulfurization zone of stage e) and preferably stages e) and f). According to a second variant of the process according to the invention, the gasoline is fractionated into at least three fractions: a light fraction, a heavy fraction, and at least one intermediate fraction.

The light fraction is identical to the one that is described above. Intermediate fraction I2 whose boiling points by way of example are at least 100° C. and at most about 140° C. and even about 160° C. This fraction can be treated in stage e) then optionally in stage f) of the process according to the invention. Heavy fraction H2 is then a fraction whose boiling points are generally greater than about 160° C. or about 140° C. In this case, the unit of intermediate fraction plus heavy fraction is equivalent to heavy fraction H1 of the case where the fractionation is limited to two fractions.

Heavy fraction H2 whose boiling points are generally greater than about 160° C. or about 140° C. is sent into the desulfurization zone.

In another version of the process according to the invention, it is also possible to fractionate the product that originates from stage c) into at least three fractions: a light fraction (L), at least one intermediate fraction (I2) and at least one heavy fraction (H2) that exhibits the properties described above.

Intermediate fraction I2 whose boiling points are between about 100° C. and about 120° C. or about 160° C. can be sent into a transformation unit of sulfur-containing compounds according to stage c) or recycled in this stage c).

After stage d), fraction or fractions I2 can again be fractionated into an intermediate fraction I3 and a heavy fraction H3. Fraction H3 that is thus obtained can optionally be mixed with fraction H2, preferably before desulfurization, and fraction I3 can be sent into a unit for transformation of sulfur-containing compounds according to stage c) or recycled in this stage c).

In the description below, the conditions given for stage e) include the one in which a single desulfurization stage is carried out and those of a preferred embodiment of the invention in which the hydrodesulfurization is carried out in two successive stages e) and f).

Decomposition of the Sulfur-Containing Compounds of the Heavy Fractions and/or Intermediate Fractions that Originate from Stage d) (Stage e):

This stage, which applies to the heavy gasoline (heavy fractions and/or intermediate fractions) obtained at the end of fractionation stage d), consists in hydrogenolyzing at least partially the sulfur-containing compounds for forming the $H_2S$. The fraction of the sulfur-containing compounds that are thus, transformed is a function of the desired desulfurization rate.

This stage can be carried out, for example, by running the heavy gasoline, in the presence of hydrogen, over a catalyst that comprises at least one element of group VIII and/or at least one element of group VIB at least in part in sulfide form, at a temperature of between about 210° C. and about 350° C., preferably between 220° C. and 320° C., under a pressure of generally between about 1 and about 4 MPa, preferably between 1.5 and 3 MPa. The volumetric flow rate of the liquid is between about 0.5 and about 20 $h^{-1}$ (expressed by volume of liquid per volume of catalyst and per hour), preferably between 0.5 and 10 h-1, very preferably between 1 and 8 h-1. The $H_2$/HC ratio is between 100 to 600 liters per liter and preferably between 200 and 500 liters per liter.

To carry out, at least in part, the hydrogenolysis of the unsaturated sulfur-containing compounds of the gasoline according to the process of the invention, generally at least one catalyst that comprises at least one element of group VIII (metals of groups 8, 9 and 10 of the new periodic table, i.e., iron, ruthenium, osmium, cobalt, rhodium, iridium, nickel, palladium or platinum) and/or at least one element of group VIB (metals of group 6 of the new periodic table, i.e., chromium, molybdenum or tungsten) is used on a suitable substrate.

The metal content of group VIII that is expressed in oxide is generally between 0.5 and 15% by weight, preferably between 1 and 10% by weight. The metal content of group VIB is generally between 1.5 and 60% by weight, preferably between 3 and 50% by weight. The element of group VIII, when it is present, is preferably cobalt, and the element of group VIb, when it is present, is generally molybdenum or tungsten. Combinations such as cobalt-molybdenum are preferred. The substrate of the catalyst is usually a porous solid, such as, for example, an alumina, a silica-alumina or other porous solids, such as, for example, magnesia, silica or titanium oxide, alone or mixed with alumina or silica-alumina. To reduce the hydrogenation of the olefins that are present in the heavy gasoline, it is advantageous preferably to use a catalyst in which the molybdenum density, expressed in % by weight of MoO3 per unit of surface area, is greater than 0.07 and preferably greater than 0.10. The catalyst according to the invention preferably has a specific surface area that is less than 190 m2/g, more preferably less than 180 m2/g, and very preferably less than 150 m2/g.

The catalyst is preferably used at least in part in its sulfurized form. The sulfurization stage can be carried out by any technique that is known to one skilled in the art, in situ or ex situ.

In the process according to the invention, the conversion of the sulfur-containing compounds is greater than 50% and preferably greater than 90%.

Stage e) is implemented under conditions such that the transformation of at least a portion of the unsaturated compounds of the sulfur, such as the thiophenic compounds, into saturated compounds, for example, into thiophanes (or thiacyclopentanes) or into mercaptans, or else to hydrogenolyze at least partially these unsaturated sulfur-containing compounds to form $H_2S$, is observed.

In the process according to this preferred embodiment of the invention, the conversion of the unsaturated sulfur-containing compounds is greater than 15% and preferably greater than 50%. In the same step, the hydrogenation rate of the olefins is preferably less than 50%, more preferably less than 40%, and very preferably less than 35%, during this stage. The effluent that is obtained from this first hydrogenolysis stage is then sent, preferably without any separation of liquid and gas, to stage f), which makes it possible to decompose the saturated sulfur-containing compounds into $H_2S$.

Decomposition of the Sulfur-Containing Compounds that are Contained in the Product that Originates from Stage e) (Stage f):

In this stage, the saturated sulfur compounds are transformed in the presence of hydrogen on a suitable catalyst. The decomposition of the unsaturated compounds that are not hydrogenated during stage e) can also take place simultaneously. This transformation is carried out, without significant hydrogenation of the olefins, i.e., that during this stage, the hydrogenation of the olefins is generally limited to 20% by volume relative to the olefin content of the starting gasoline, and preferably, limited to 10% by volume relative to the olefin content of the starting gasoline.

The catalysts that are suitable for this stage of the process according to the invention, without this list being limiting, are catalysts that generally comprise at least one basic element that is selected from among the elements of group VIII and group VIB, and preferably selected from the group that is formed by nickel, cobalt, iron, molybdenum, and tungsten. These metals can be used alone or in combination; they are preferably supported and used in their sulfurized form. The catalyst of stage f) preferably has a nature and/or composition different from the one used in stage e). The base metal content of the catalyst, according to the invention is generally between about 1 and about 60% by weight, preferably between 5 and 30% by weight, and very preferably between 10 and 25% by weight. Preferably, the catalyst is generally shaped, preferably in the form of balls, pellets, extrudates, for example trilobes. The metal can be incorporated into the catalyst by deposition on the preformed substrate; it can also be mixed with the substrate before the shaping stage. The metal is generally introduced in the form of a precursor salt, generally water-soluble, such as, for example, the nitrates and the heptamolybdates. This method of introduction is not specific to the invention. Any other method of introduction that is known to one skilled in the art may be suitable. A catalyst that contains at least one element of group VIII, and in particular nickel, is very advantageously used.

The substrates of catalysts that are used in this stage of the process according to the invention are generally porous solids that are selected from among the refractory oxides, such as, for example, the aluminas, silicas and silica-aluminas, magnesia, as well as titanium oxide and zinc oxide, whereby these latter oxides can be used alone or mixed with alumina or silica-alumina. The substrates are preferably transition aluminas or silicas whose specific surface area is 25-350 $m^2/g$. The natural compounds, such as, for example, the diatomaceous earth or the kaolin, can also be suitable as substrates of catalysts that are used in this stage of the process.

The catalyst is preferably used at least in part in its sulfurized form. This offers the advantage of limiting as much as possible the hydrogenation risks of the unsaturated compounds such as the olefins or the aromatic compounds during the start-up phase. The sulfurization stage can be carried out by any technique that is known to one skilled in the art, in situ or ex situ.

After sulfurization, the sulfur content of the catalyst is generally between 0.5 and 25% by weight, preferably between 4 and 20% by weight and very preferably between 4 and 10% by weight. The purpose of the hydrodesulfurization that is carried out during this stage is to convert into $H_2S$ the saturated sulfur-containing compounds of the gasoline that already underwent at least one preliminary hydrogenation of the unsaturated compounds of sulfur during stage e). It makes it possible to obtain an effluent that meets the desired specifications in terms of content of sulfur-containing compounds. The gasoline that is thus obtained exhibits only a small octane loss. The treatment that aims at decomposing the saturated sulfur-containing compounds that originate from stage e) of the process is carried out in the presence of hydrogen, with the catalyst that comprises at least one base metal that is selected from the group that is formed by nickel, cobalt, iron, molybdenum, tungsten, at a temperature of between about 280° C. and about 400° C., preferably between about 290° C. and about 380° C., more preferably between 310° C. and 360° C., and very preferably between 320° C. and 350° C., under a pressure that is generally between about 0.5 and about 5 MPa, preferably between 1 and 3 MPa, more preferably between 1.5 and 3 MPa. The volumetric flow rate of the liquid is between about 0.5 and about 10 $h^{-1}$ (expressed by volume of liquid per volume of catalyst and per hour), preferably between 1 and 8 $h^{-1}$. The $H_2$/HC ratio is adjusted based on the desired hydrodesulfurization rates in the range of between about 100 and about 600 liters per liter, preferably between 100 and 300 liters per liter. All or part of this hydrogen can optionally be obtained from stage e) (unconverted hydrogen)

or a recycling of the unconsumed hydrogen in stages a), b) or c). It was found that the implementation of this second catalyst in this stage, under particular operating conditions, makes it possible to decompose the saturated compounds, contained in the effluent that originates from stage c, into H2S. This implementation makes it possible to reach a high overall level of hydrodesulfurization at the end of all of the stages of the process according to the invention, while minimizing the octane loss that results from the saturation of the olefins, because the conversion of the olefins during stage e) is generally limited to at most 20% by volume of the olefins, preferably at 10% by volume.

In a particular embodiment, according to the characteristics of the starting gasoline feedstock, the latter is freed of the majority of its basic nitrogen-containing compounds that are at least in part eliminated before stage c) for alkylation of at least a portion of the sulfur-containing compounds that are present in the product that originates from stage b). According to a preferred embodiment, the basic nitrogen-containing compounds that are contained in the starting gasoline are at least in part eliminated before its introduction into stage a) for hydrogenation of the polyunsaturated compounds. Most often, the elimination of the basic nitrogen-containing compounds is carried out by a treatment (washing) with an acid aqueous solution. Thus, when, the starting gasoline contains basic nitrogen-containing compounds, the latter are at least in part eliminated by a treatment with the help of an acid aqueous solution that is carried out before stage c) for alkylation of at least a portion of the sulfur-containing compounds that are present in the product that originates from stage b). This washing is usually carried out before or after the selective hydrogenation treatment in stage a) of the polyunsaturated compounds that are contained in the starting gasoline.

The catalysts that are used in stages e) and f) are most often separate sulfurized catalysts.

Description Of The Single Figure (Which diagrammatically Illustrates, in a Nonlimiting Manner, an Embodiment of the Invention)

Gasoline (α) that contains sulfur-containing compounds, diolefins and olefins is injected into line (1). The hydrogen is injected into line (2) in an amount such that the hydrogen/diolefin molar ratio is greater than 1. The gasoline and the hydrogen are brought into contact in a reactor (A) for selective hydrogenation of diolefins, under optimized conditions for limiting the saturation of olefins while hydrogenating the diolefins.

The effluent of reactor (A) is sent via line (3) into a unit for increasing the weight of sulfur-containing compounds (B). The reactions that are implemented in this reactor (B) are essentially reactions for increasing the weight of mercaptans from 1 to 6 carbon atoms as well as sulfides with 2 to 6 carbon atoms. A partial conversion of the compounds such as the CS2 and COS is also observed. The gasoline that is produced is introduced via line (4) into a reactor (C) for increasing the weight of sulfur-containing compounds by addition to the olefins. The sulfur-containing compounds that are primarily increased in weight in this reactor are the thiophenic compounds. Also in this reactor (C), oligomerization reactions of olefins and partial alkylation of benzene compounds are observed. The gasoline that is produced in this reactor (C) is therefore both heavier than gasoline (α) and depleted of light sulfur-containing compounds. The gasoline that is produced in reactor (C) is injected via line (5) into a fractionation column (D) that separates the gasoline into at least two fractions.

The light gasoline whose end point can be between 55° C. and 160° C. is recovered at the top of the column. This gasoline is desulfurized and does not require additional treatment. The final temperature of this light gasoline is set by the maximum amount of sulfur allowed.

The heavy gasoline that is recovered at the bottom of the column via line (7) is sent after mixing with the hydrogen that is introduced via line (8) to a desulfurization section (E+F). This gasoline has a distillation starting point between 50° C. and 130° C.

Hydrodesulfurization section (E+F) is designed to desulfurize the gasoline while limiting the hydrogenation of olefins, which makes it possible to limit the octane loss. It consists of at least two reactors in series, the first (E) of which comprises an optimized catalytic system for saturating the thiophenic compounds and partially transforming the sulfur-containing compounds into H2S. The second contains a catalyst that is an optimized catalyst for transforming the mercaptans into H2S, by limiting the hydrogenation of olefins that are present in the gasoline. This desulfurization scheme has been described in Patent Application EP 1 077 247.

The heavy gasoline that is recovered via line (10) and the light gasoline that is recovered via line (6) can be mixed to produce a complete desulfurized gasoline that is recovered via line (11).

EXAMPLE 1 (For Comparison)

A cracking gasoline is subjected to a hydrogenation treatment of the diolefins under conditions where the saturated sulfur-containing light compounds that are present in the feedstock are partly converted into heavier compounds.

This treatment is carried out in a continuously-operating reactor. The catalyst has a nickel and molybdenum base (catalyst marketed by the Procatalyse Company under reference HR945). The reaction is performed at 180° C. under a total pressure of 2.6 MPa, with a volumetric flow rate of 6 $h^{-1}$. The $H_2$/feedstock ratio, expressed in liter of hydrogen per liter of feedstock is 10.

The characteristics of the catalytic cracking gasoline and the effluent after hydrogenation of diolefins and conversion of light compounds are indicated in Table 1.

TABLE 1

| | Starting Gasoline | Gasoline after Hydrogenation (Stages a and b) |
|---|---|---|
| Density 15/4 | 0.7215 | 0.7237 |
| Bromine Number (gBr/100 g) | 78 | 74 |
| Olefins (GC) % by weight | 43 | 40.5 |
| MAV (mg/g) | 10 | 0.2 |
| Research Octane Number | 93 | 92.5 |
| Motor Octane Number | 79.6 | 79.4 |
| Mercaptans (ppm) | 26 | 4 |
| S Total (ppm) | 350 | 350 |
| Fraction Points (DS) | | |
| 0.5% | 2 | 2 |
| 5% | 23 | 24 |
| 10% | 30 | 31 |
| 50% | 86 | 87 |
| 90% | 141 | 143 |
| 95% | 152 | 151 |
| 99.5% | 175 | 175 |

At the end of this treatment, the gasoline is separated into two fractions: a light fraction that represents 65% by weight of the distilled gasoline whose fraction point corresponds to a temperature of 100° C. and a heavy fraction. The separation is carried out on a batch-type distillation column that consists of 30 theoretical plateaus. The characteristics of the two fractions that are obtained are provided in Table 2.

TABLE 2

| | Light Fraction PI-100 | Heavy Fraction 100-175 |
|---|---|---|
| Density 15/4 | 0.6826 | 0.7712 |
| Bromine Number (gBr/100 g) | 91 | 48 |
| MAV (mg/g) | <0.2 | <0.2 |
| Research Octane Number | 93.4 | 91.8 |
| Motor Octane Number | 79.9 | 79 |
| Mercaptans (ppm) | 3 | 4 |
| S Total (ppm) | 62 | 885 |
| Fraction Points (DS) | | |
| 0.5% | 4 | 93 |
| 5% | 20 | 99 |
| 10% | 22 | 108 |
| 50% | 60 | 128 |
| 90% | 96 | 145 |
| 95% | 99 | 152 |
| 99.5% | 110 | 177 |

The light fraction exhibits contents of diolefins, mercaptans and sulfur such that it can be used directly, provided that the specification on the sulfur content is greater than 60 ppm.

The heavy gasoline should be desulfurized before use. In all of the cases, this scheme does not make it possible to produce a desulfurized gasoline that contains less than 40 ppm of sulfur by recombining the light gasoline and the heavy gasoline.

EXAMPLE 2 (For Comparison)

The catalytic cracking gasoline that is obtained in Example, after hydrogenation treatment is separated into two fractions, a light fraction that represents 20% by weight of distilled gasoline whose fraction point corresponds to a temperature of 55° C. and a heavy fraction. The separation is carried out on the same column as in Example 1. The characteristics of the two fractions that are obtained are provided in Table 3.

TABLE 3

| | Light Fraction PI-55 | Heavy Fraction 55-175 |
|---|---|---|
| Density 15/4 | 0.65 | 0.77 |
| Bromine Number (gBr/100 g) | 130 | 65 |
| Olefins (GC) | 60 | 36 |
| MAV (mg/g) | <0.2 | <0.2 |
| Research Octane Number | 95 | 90.5 |
| Motor Octane Number | 81.5 | 80 |
| Mercaptans (ppm) | <1 | 4 |
| S Total (ppm) | 2 | 437 |
| Fraction Points (DS) | | |
| 0.5% | 4 | 52 |
| 5% | 20 | 54 |
| 10% | 22 | 67 |
| 50% | 36 | 102 |
| 90% | 41 | 138 |
| 95% | 54 | 151 |
| 99.5% | 72 | 176 |

The light gasoline that is produced by distillation exhibits contents of mercaptans, diolefins and sulfur such that it can be used directly.

The heavy gasoline requires an additional desulfurization.

The heavy gasoline is therefore subjected to a hydrodesulfurization on a scheme of catalysts in an isothermal tubular reactor.

The first catalyst (catalyst A) is obtained by impregnation "without excess solution" of a transition alumina that comes in the form of balls with a specific surface area of 130 $m^2/g$ and a pore volume of 0.9 ml/g, by an aqueous solution that contains molybdenum and cobalt in the form of ammonium heptamolybdate and cobalt nitrate. The catalyst is then dried and calcined under air at 500° C. The content of cobalt and molybdenum of this sample is 3% of CoO and 14% of MoO3.

The second catalyst (catalyst B) is prepared from a transition alumina of 140 $m^2/g$ that comes in the form of balls that are 2 mm in diameter. The pore volume is 1 ml/g of substrate. A kilogram of substrate is impregnated by 1 liter of nickel nitrate solution. The catalyst is then dried at 120° C. and calcined under a stream of air at 400° C. for one hour. The nickel content of the catalyst is 20% by weight. 100 ml of catalyst A and 200 ml of catalyst B are placed in two reactors in series, so that the feedstock that is to be treated (heavy fraction) first encounters catalyst A, then catalyst B. A zone for sampling the effluent that originates from stage e is provided between catalysts A and B. The catalysts are first sulfurized by treatment for 4 hours under a pressure of 3.4 MPa at 350° C., upon contact with a feedstock that contains 2% by weight of sulfur in the form of dimethyl disulfide in n-heptane.

The operating conditions of hydrodesulfurization are as follows: VVH=1.33 $h^{-1}$ relative to a complete catalyst bed $H_2$/HC=300 l/l, P=2.0 MPa. The temperature of the catalytic zone that comprises catalyst A is 280° C., whereby the temperature of the catalytic zone that contains catalyst B is 330° C.

The characteristics of the effluents that are thus obtained are presented in Table 4.

TABLE 4

| | Starting Heavy Fraction 55-175 | Desulfurized Heavy Fraction 55-175 | Mixture of the Light Gasoline and the Desulfurized Heavy Gasoline PI-175 |
|---|---|---|---|
| Density 15/4 | 0.7732 | 0.7696 | 0.7228 |
| Bromine Number (gBr/100 g) | 65 | 38.5 | 56.2 |
| Olefins (GC) % by Weight | 36 | 25 | 32 |
| MAV (mg/g) | <0.2 | <0.2 | <0.2 |
| Research Octane Number | 90.5 | 85.4 | 88.9 |
| Motor Octane Number | 80 | 76 | 78.2 |
| Mercaptans (ppm) | 4 | 12 | 10.4 |
| S Total (ppm) | 437 | 30 | 25 |
| Fraction Points (DS) | | | |
| 0.5% | 52 | | 2 |
| 5% | 54 | | 23 |
| 10% | 67 | | 30 |
| 50% | 102 | | 86 |
| 90% | 138 | | 141 |
| 95% | 151 | | 152 |
| 99.5% | 176 | | 175 |

This scheme as described in Patent Application EP 1 077 247 makes it possible to produce a desulfurized gasoline whose contents of mercaptans and diolefins are compatible with the grades that are required for the gasolines.

In the particular case of this example, the desulfurization rate is 92.8%, the residual sulfur content is 25 ppm and the octane loss that is calculated by the formula (RON+MON)/2 is 2.75 points.

EXAMPLE 3 (According to the Invention)

The catalytic cracking gasoline that is obtained in Example 1 after hydrogenation treatment [stages a) and b) according to the invention] is sent to a reactor for increasing the weight of sulfur-containing compounds by alkylation by the olefins (stage c) according to the invention). This stage is implemented in a tubular reactor that contains catalyst with a phosphoric acid base that is supported on silica that contains 20% by weight of phosphoric acid (catalyst C) under the following operating conditions: VVH=1 h-1, pressure=2.0 MPa, temperature=180° C. Before injection in the reactor, the feedstock is supplemented with isopropanol at a level of 500 ppm, intended to hydrate the catalyst continuously in the reactor.

The effluent that is thus produced is separated into two fractions with a distillation column as described in Example 1. The distillation fraction point is set at 100° C.; the light fraction represents 50% by weight of the starting gasoline.

The characteristics of the gasoline produced during alkylation stage c) and fractionation stage d) are provided in Table 5.

TABLE 5

| | Gasoline after Being Increased in Weight by Alkylation (Stage c) PI-240 | Light Fraction (Stage d) PI-100 | Heavy Fraction (Stage d) 100-240 |
|---|---|---|---|
| Density 15/4 | 0.7641 | 0.6921 | 0.8124 |
| Bromine Number (gBr/100 g) | 62 | 53 | 72 |
| MAV (mg/g) | <0.2 | <0.2 | <0.2 |
| Research Octane Number | 91.4 | 86.2 | 93.6 |
| Motor Octane Number | 80.7 | 79.5 | 81.7 |
| Mercaptans (ppm) | 5 | 4 | |
| S Total (ppm) | 350 | 18 | 670 |
| Fraction Points (DS) | | | |
| 0.5% | 6 | 6 | 94 |
| 5% | 23 | 19 | 102 |
| 10% | 30 | 24 | 108 |
| 50% | 105 | 61 | 154 |
| 90% | 206 | 97 | 210 |
| 95% | 215 | 100 | 219 |
| 99.5% | 240 | 111 | 238 |

The light gasoline that is recovered at the outlet of the fractionation stage exhibits total contents of diolefins, mercaptans and sulfur such that it can be used without additional treatment. The heavy gasoline requires a desulfurization stage.

The desulfurization of the heavy gasoline (stages e) and f) of the process according to the invention) is carried out with the device that is described in Example 2. The operating conditions are as follows: VVH=1.33 $h^{-1}$ relative to a complete catalyst bed $H_2$/HC=300 l/l, P=2.0 MPa. The temperature of the catalytic zone that comprises catalyst A is 290° C.; the temperature of the catalytic zone that contains catalyst B is 340° C.

The gasoline that is thus produced exhibits no more than a sulfur content of 26 ppm. It can be used without additional treatment. This gasoline is recombined with the light gasoline that is recovered in stage d).

The characteristics of the desulfurized heavy gasoline and the recombined gasoline are provided in Table 6.

TABLE 6

| | Starting Gasoline PI-175 | Light Gasoline (Stage d) PI-100 | Desulfurized Heavy Gasoline (Stages e) and f) 100-240 | Recombined Light Gasoline and Heavy Gasoline PI-240 |
|---|---|---|---|---|
| Density 15/4 | 0.7215 | 0.6921 | 0.8134 | 0.7683 |
| Bromine Number (gBr/100 g) | 80 | 53 | 37 | 45 |
| Olefins (GC) % by Weight | 44 | | | |
| MAV (mg/g) | 12 | <0.2 | <0.2 | <0.2 |
| Research Octane Number | 93 | 86.2 | 90.4 | 88.8 |
| Motor Octane Number | 79.8 | 79.5 | 80.2 | 79.7 |
| Mercaptans (ppm) | 20 | 4 | 12 | 9 |
| Sulfur, Not Mercaptan (ppm) | 330 | 14 | 24 | 17 |
| S Total (ppm) | 350 | 18 | 36 | 26 |

This scheme that is carried out according to the invention makes it possible to produce a desulfurized gasoline with a limited octane loss, whose contents of mercaptan and diolefins are compatible with the grades that are required for the gasolines.

In the particular case of this example, the desulfurization rate is 92.6%; the residual sulfur content is 26 ppm, and the octane loss that is calculated by formula (RON-1-MON/2) is 2.15 points.

The invention claimed is:

1. A process for the production of gasoline with a low sulfur content from a starting gasoline that contains at least 150 ppm by weight of sulfur-containing compounds comprising:

a) selectively hydrogenating non-aromatic, polyunsaturated compounds that are present in the starting gasoline, thus reducing diolefins to mono-olefins b) increasing the molecular weight of light sulfur-containing products that are initially present in the gasoline that is introduced in a) and/or those that are contained in the product that originates from a), by reacting mercaptans with said mono-olefins from a) in the presence of a sulfided, nickel-based catalyst, c) alkylating of at least a portion of sulfur-containing compounds, that are present in the product that originates from b), thereby obtaining sulfur-containing compounds with a higher molecular weight, d) fractionating gasoline that originates from c) into at least two fractions, a first fraction that is virtually lacking in sulfur and that contains lightest olefins of unconverted starting gasoline in c), and at least one other fraction, heavier than said first fraction, enriched with sulfur-containing compounds, and e) treating at least one heavier fraction that originates from d) on a catalyst that makes it possible to decompose at least partially sulfur-containing compounds.

2. The process according to claim 1, in which e) is carried out under conditions where the hydrogenation of olefins on this catalyst is limited.

3. A process according to claim 1 further comprising f) treating product that is obtained in e), without elimination of the $H_2S$ that is formed during e), on a catalyst and under conditions that make it possible to decompose at least partially sulfur-containing compounds that are not transformed during e) with a limited hydrogenation of olefins.

4. The process according to claim 1, in which the starting gasoline is a catalytic cracking gasoline whose final boiling points are from about 120° C. to about 230° C.

5. The process according to claim 3, in which the conditions of f) are selected so as to decompose unsaturated sulfur-containing compounds and the linear and/or cyclic saturated sulfur-containing compounds that are not transformed during e), with a limited hydrogenation of olefins.

6. The process according to claim 1, in which the molecular weight of the light sulfur-containing products that are initially present in the a) and b) are carried out simultaneously in a single reaction zone that contains one or more beds of a single catalyst.

7. The process according to claim 1, in which the starting gasoline contains basic nitrogen-containing compounds that are at least in part eliminated before c).

8. The process according to claim 7, in which basic nitrogen-containing compounds that are contained in the starting gasoline are at least partly eliminated before introduction of the starting gasoline into a).

9. The process according to claim 7 , in which the elimination of the basic nitrogen-containing compounds is carried out by a treatment with an acid aqueous solution.

10. The process according to claim 3, in which the desulfurized heavy gasoline that originates from f) is subjected to a stripping treatment gas.

11. The process according to claim 3, in which e) and f) are carried out in at least two successive and separate reaction zones.

12. The process according to claim 3, in which light gasoline that originates from d) and at least a portion of heavy gasoline that originates from f) are mixed to form the overall desulfurized gasoline.

13. The process according to claim 1, in which the catalyst of e) comprises at least one element of group VIII and at least one element of group VIB.

14. The process according to claim 3, in which the catalyst of f) comprises at least one element of group VIII.

15. The process according to claim 3, in which the catalysts that are used in e) and f) are separate sulfurized catalysts.

16. The process according to claim 3, in which e) and f) are carried out in two reactors that are placed in series, whereby the second reactor treats the effluent of the first reactor as a whole.

17. The process according to claim 3, in which alkylation in c) is carried out under conditions such that a portion of olefins of the starting gasoline is converted into long branched olefins by addition reactions between olefins and such that a portion of the aromatic compounds is increased in weight by alkylation by olefins.

18. The process according to claim 1, in which the heavy fraction that originates from d) is sent into a fractionation zone so as to obtain a heavy fraction that is enriched with sulfur and a lighter fraction that is low in sulfur.

19. The process according to claim 3, in which the gasoline that originates from hydrodesulfurization e) or f) is sent into a fractionation zone so as to obtain a heavy fraction that is enriched with sulfur and a lighter fraction that is low in sulfur.

* * * * *